US006837860B1

(12) United States Patent
Auletta

(10) Patent No.: US 6,837,860 B1
(45) Date of Patent: Jan. 4, 2005

(54) CRANIAL BASE MASSAGE UNIT

(76) Inventor: Lynda Auletta, 705 Mermaid Dr. unit 104, Deerfield Beach, FL (US) 33441

( * ) Notice: Subject to any disclaimer, the term of this patent is extended or adjusted under 35 U.S.C. 154(b) by 249 days.

(21) Appl. No.: 10/261,259

(22) Filed: Sep. 30, 2002

(51) Int. Cl.[7] ..... A61H 7/00

(52) U.S. Cl. ..... 601/86; 601/87; 601/112; 601/134

(58) Field of Search ..... 601/46, 48, 70, 601/71, 79, 85, 86, 87, 103, 112, 113, 133, 134; D24/211, 214, 215

(56) References Cited

U.S. PATENT DOCUMENTS 2,547,243 A * 4/1951 Amer ..... 601/137
4,210,134 A * 7/1980 Okazaki et al. ..... 601/134
5,063,911 A * 11/1991 Teranishi ..... 601/46
5,421,799 A * 6/1995 Rabin et al. ..... 601/71
5,611,771 A * 3/1997 Taylor ..... 601/70
6,039,704 A * 3/2000 Domenighini et al. ..... 601/79
6,656,139 B2 * 12/2003 Zwezdaryk ..... 601/46
6,695,796 B1 * 2/2004 Solmor ..... 601/5

* cited by examiner

*Primary Examiner*—Danton D. DeMille
*Assistant Examiner*—Quang D Thanh
(74) *Attorney, Agent, or Firm*—Michael I. Kroll

(57) ABSTRACT

The present invention 10 discloses a portable hand-shaped massage unit having a power source 30 contained within the unit wherein a number of appendages 20 resembling fingers extending outwardly therefrom and each finger-like appendage having a third member 26 secured to a second member by a spring 34, the second member being a motor 24 and having a shaft 36 extending outwardly and angularly connected to a first member 22 whereby when the motor 24 is switched on the motor 24 will rotate the first member 22 in an elliptical manner so that when the portable hand-shaped massage unit 10 is secured by hook and loop material 28, pins, buckles, or belts to the headrest area of a chair 16, floor 12, or bed and the unit 10 is switched on the finger-like appendages 20 will travel in a randomly elliptical manner providing a mechanical massage of the lower cranial area of the head 18 of the user 14.

15 Claims, 9 Drawing Sheets

CRANIAL BASE MASSAGE UNIT

BACKGROUND OF THE INVENTION

1. Field of the Invention

The present invention relates generally to mechanical massage units and more specifically to a portable hand-shaped massage unit having a power source contained within said unit wherein a number of appendages resembling fingers extended outwardly.

Each finger-like appendage has a first member providing means for securing a spring to a second member motor that is connected to a shaft extending outwardly and angularly connected to a third massaging member.

When said motor is switched on it will rotate said third member in an elliptical manner. Therefore, when the portable hand-shaped massage unit is secured by means of hook and loop material, pins, buckles, or belts to the headrest area of a chair or placed on the floor, carpet or firm bed and a user placed the base of their cranium against the unit and the unit is switched on the finger-like appendages will travel in a randomly elliptical manner providing a mechanical massage of the lower cranial area.

2. Description of the Prior Art

There are generic massage units which are available and may be suitable for the purposes for which they were designed, they would not be as suitable for the present invention as hereinafter described.

It is thus desirable to provide a portable hand-shaped massage unit having means for cradling the back of the head and having means for attaching said portable hand-shaped massage unit to the headrest area of various types of chairs or on thee floor or bed.

It is still further desirable to provide said portable hand-shaped massage unit with a number of motorized appendages acting independently thereby providing a random pattern giving the user a more natural massage.

SUMMARY OF THE PRESENT INVENTION

The present invention discloses a portable hand-shaped massage unit having a power source contained within the unit wherein a number of appendages resembling fingers extend outwardly therefrom. Each finger-like appendage has a third member providing means for securing a spring to a motor being the second member and having a shaft extending outwardly and angularly connected to a first member whereby when the motor is switched on the motor will rotate the first member in an elliptical manner so that when the portable hand-shaped massage unit is secured by means of hook and loop material, pins, buckles, or belts to the headrest area of a chair, floor, or bed and the unit is switched on the finger-like appendages will travel in a randomly elliptical manner providing a mechanical massage of the lower cranial area of the head of the user.

A primary object of the present invention is to provide a portable hand-shaped massage unit.

Another object of the present invention is to provide a portable hand-shaped massage unit which can be attached to the headrest of various types of chairs.

Yet another object of the present invention is to provide a portable hand-shaped massage unit with a self contained power supply whereby the unit can be used wherever necessary or desired.

Still yet another object of the present invention is to provide a portable hand-shaped massage unit having a number of independently working appendages thereby providing a more natural feel to the massage therapy.

Additional objects of the present invention will appear as the description proceeds.

The present invention overcomes the shortcomings of the prior art by providing a portable hand-shaped massage unit that can be attached to the headrest of various chairs wherein the device will cradle the head will independently motorized appendages move in a random pattern around the base of the cranium providing massage therapy.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following description is, therefore, not to be taken in a limiting sense, and the scope of the present invention is best defined by the appended claim.

LIST OF REFERENCE NUMERALS

Figure 1:
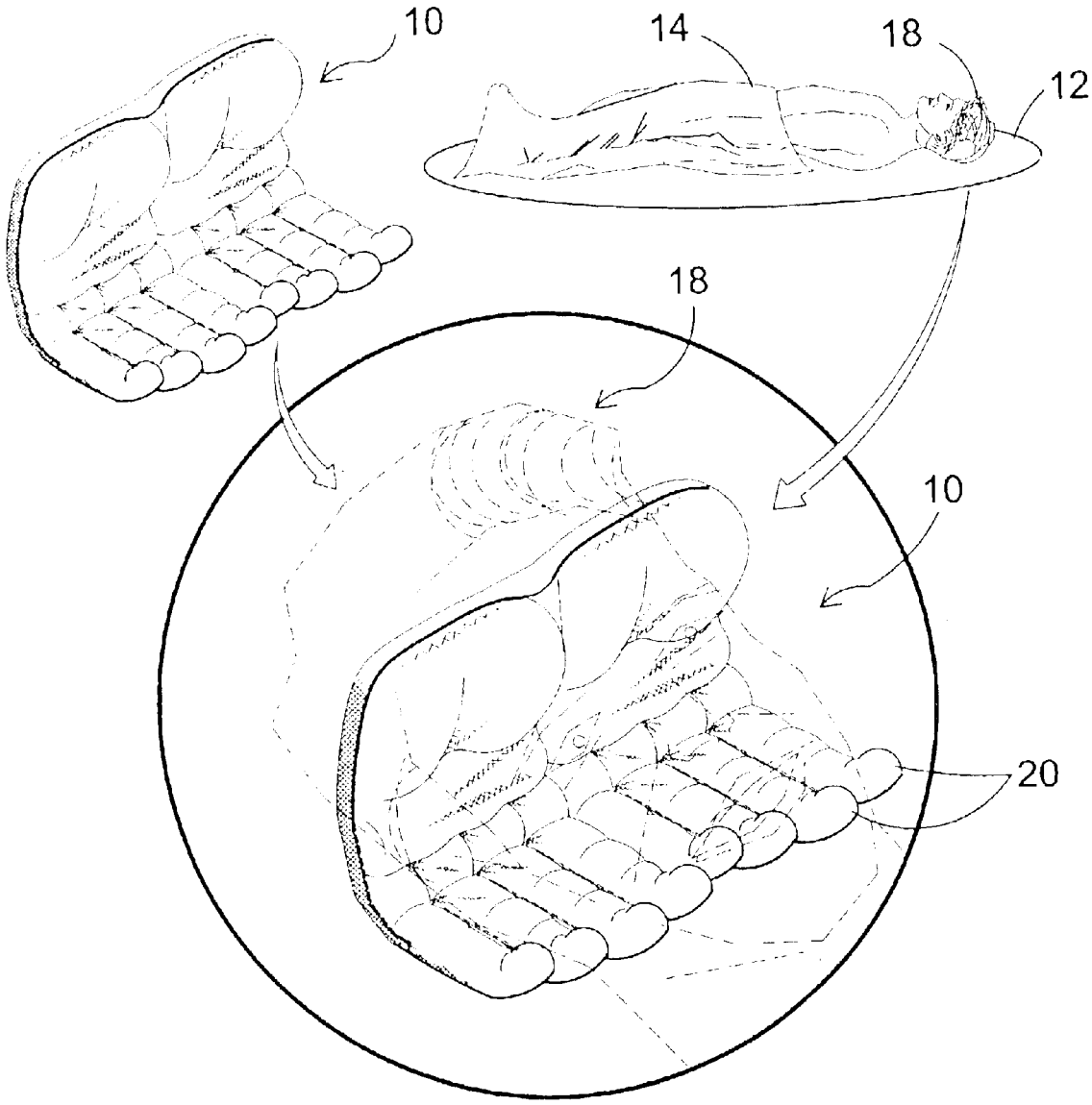
FIG. 1 is a perspective view of the present invention in use.

With regard to reference numerals used, the following numbering is used throughout the drawings.

10 present invention
12 floor
14 user
15 housing
16 chair
18 head
19 arrow
20 appendages
21 palm area
22 first member
24 second member
26 third member
28 hook and loop material
30 power source
32 wires
34 springs
36 shaft
38 padding
40 bearing

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is a perspective view of the present invention 10 in use. Shown are two, side-by-side cranial base massage units 10 placed on the floor 12 while a user 14 rests the back of the head 18 and neck on the two devices while independently operating appendages 20 provide massage therapy.

Figure 2:
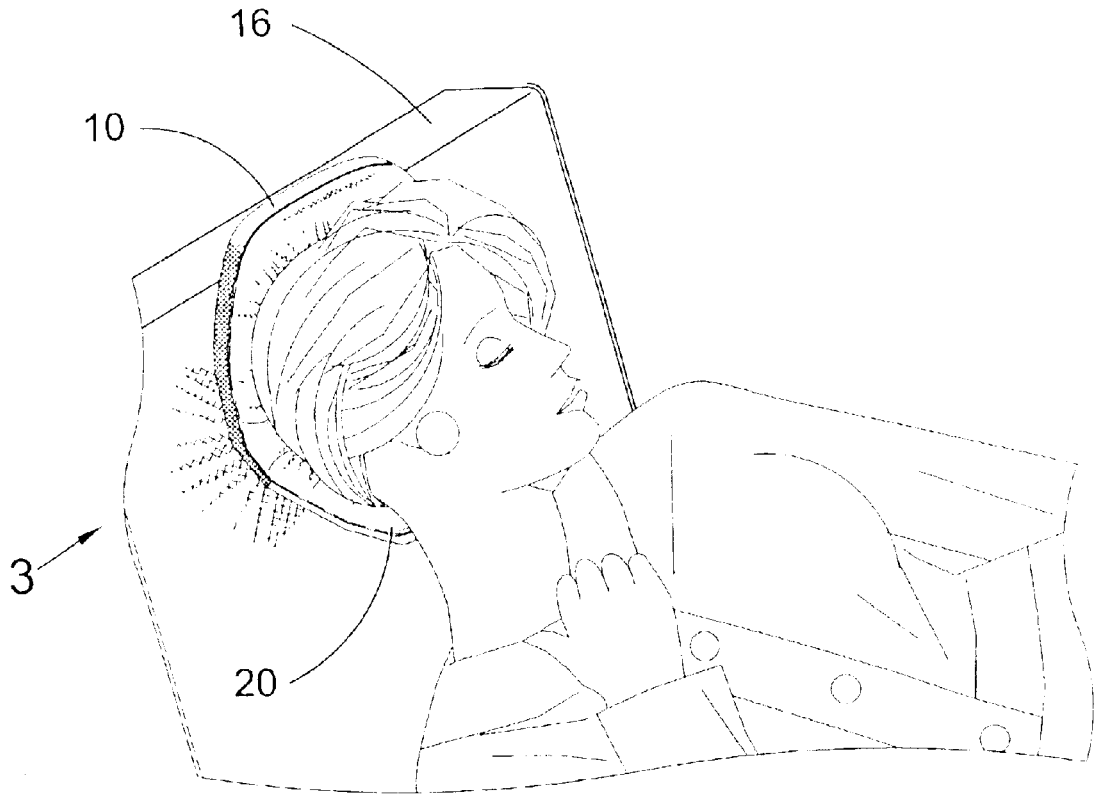
FIG. 2 is a perspective view of the present invention in use.

Turning to FIG. 2, shown therein is a perspective view of the present invention 10 in use. Shown is the device 10 attached to the headrest area of a chair 16 while a user 14 rests the back of the head 18 in the device while the independently operating appendages 20 provide massage therapy.

Figure 3:
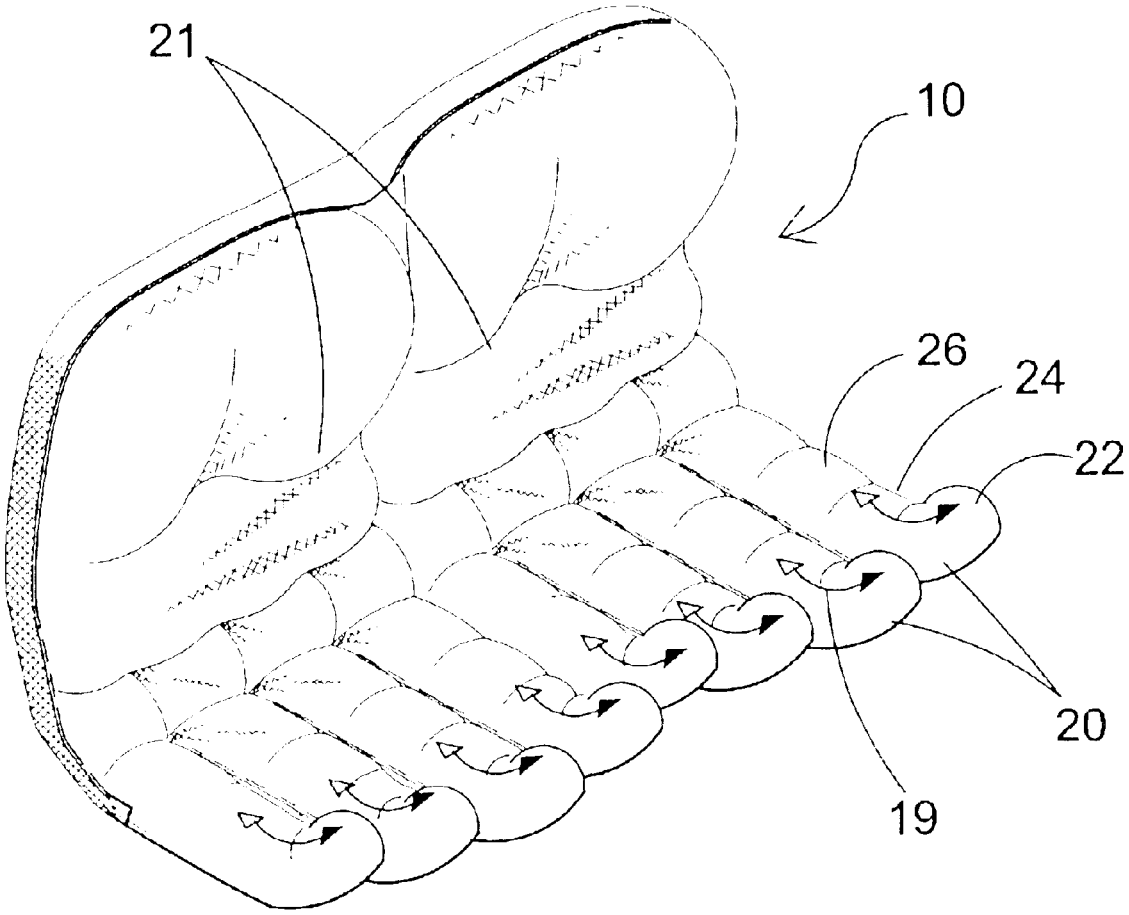
FIG. 3 is an enlarged frontal view of the present invention.

Turning to FIG. 3, shown therein is an enlarged frontal view, taken from FIG. 1 as indicated, of the present invention 10. Shown is a padded device having a number of appendages 20 extending therefrom, and, a U-shaped device for receiving the back of a lead therein formed by the appendages 20 and palm area 21 of the device. Also shown with arrows 19 is the original position of the appendages 20 before the pressure of the users head and neck compressed the spring between the third 26 and second 24 members of the appendage members 20 which will provide a consistent forward pressure as the motor (not shown but see FIG. 5) rotates the first member 22.

Figure 4:
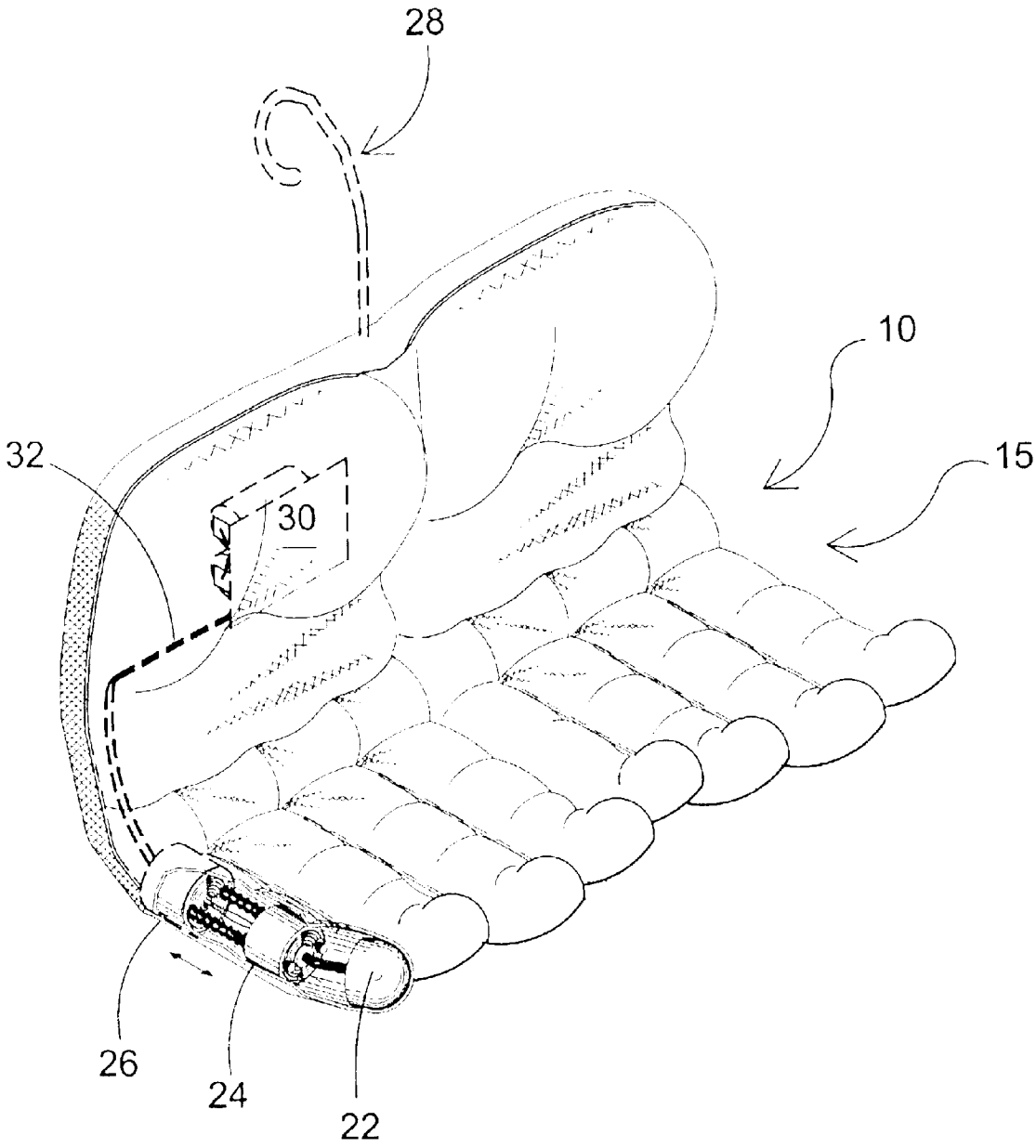
FIG. 4 is a side elevation of the present invention.

Turning to FIG. 4, shown therein is side elevation of the present invention 10, taken from FIG. 1 as indicated showing the hook and loop material 28 which is used as the means for attaching the device 10 to the headrest of a chair. It would also be possible to use buckles, straps, belts, snaps and pins as the means for securing the device 10 to a chair. Also shown are a power source 30, wires 32, and the first 22, second 24, and third members 26. It can be seen that a housing 15 is formed by the hand-shaped unit for containing the present invention 10.

Figure 5:
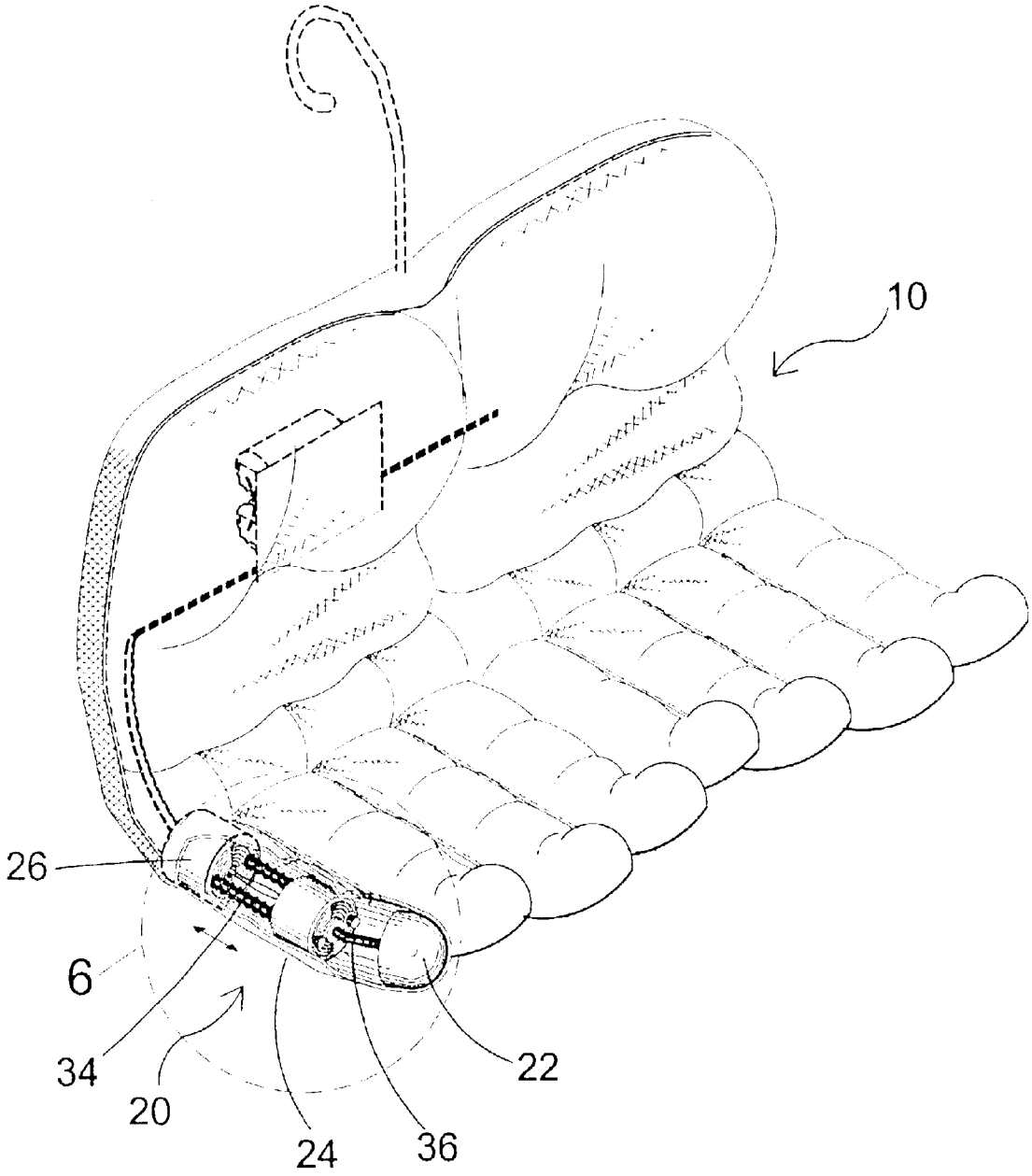
FIG. 5 is a cutaway view of the present invention.

Turning to FIG. 5, shown therein is a cutaway view of one of the appendages 20 of the present invention 10. Shown is a third member 26 which is used to secure the motorized second member 24 by means of springs 34 which will compress as pressure is placed on the device 10 by the head of a user. The second member 24 has a shaft 36 as means for securing and rotating the first member 22 in an oscillating motion which thereby massages the back of the head of a user.

Figure 6:
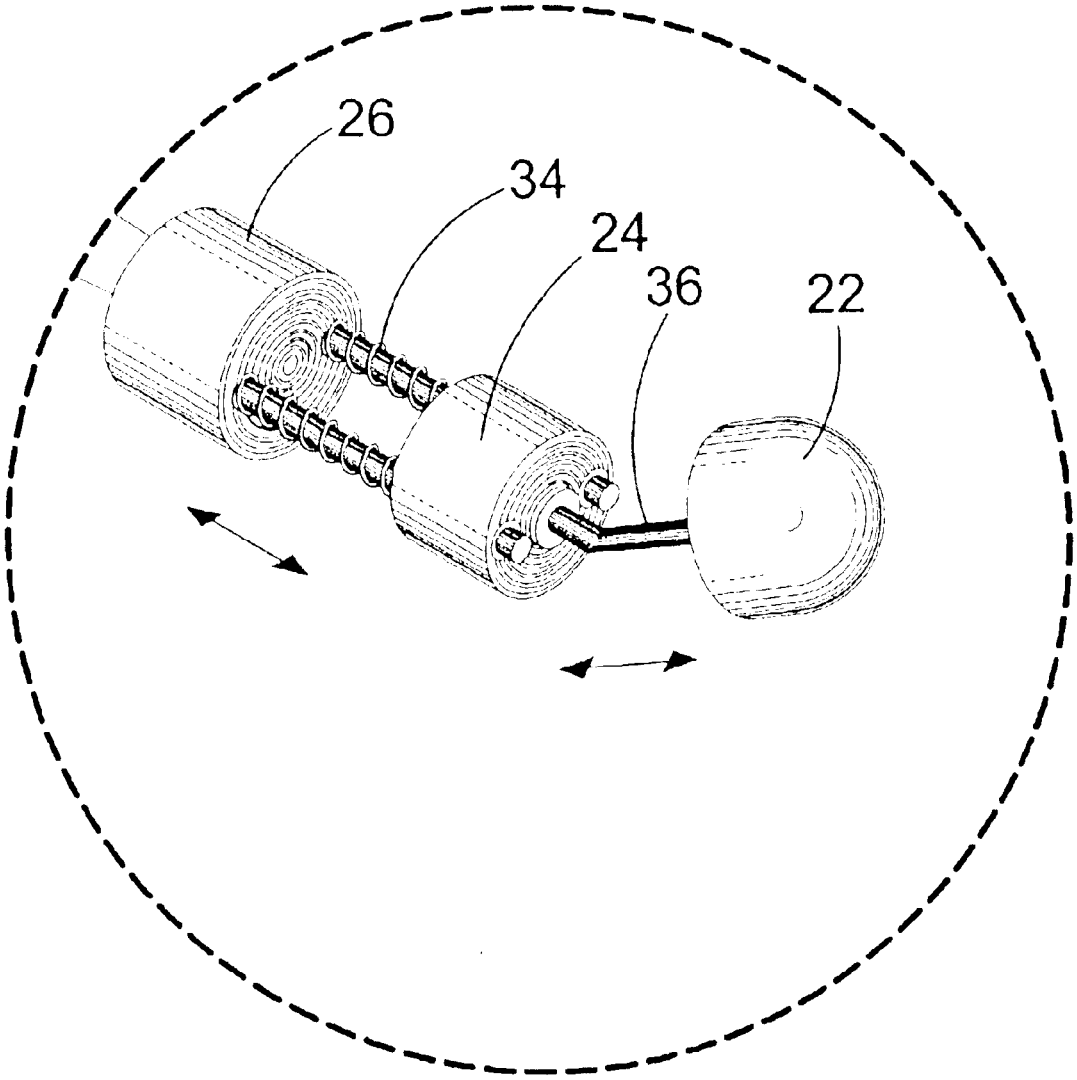
FIG. 6 is an enlarged view of the present invention.

Turning to FIG. 6, shown therein is an enlarged view, taken from FIG. 5 as indicated. Shown is a third member 26 which is used to secure the motorized second member 24 by means of springs 34 which will compress as pressure is placed on the device. The second member 24 has a shaft 36 as means for securing and moving the first member 22 in a partially rotational motion back and forth.

Figure 7:
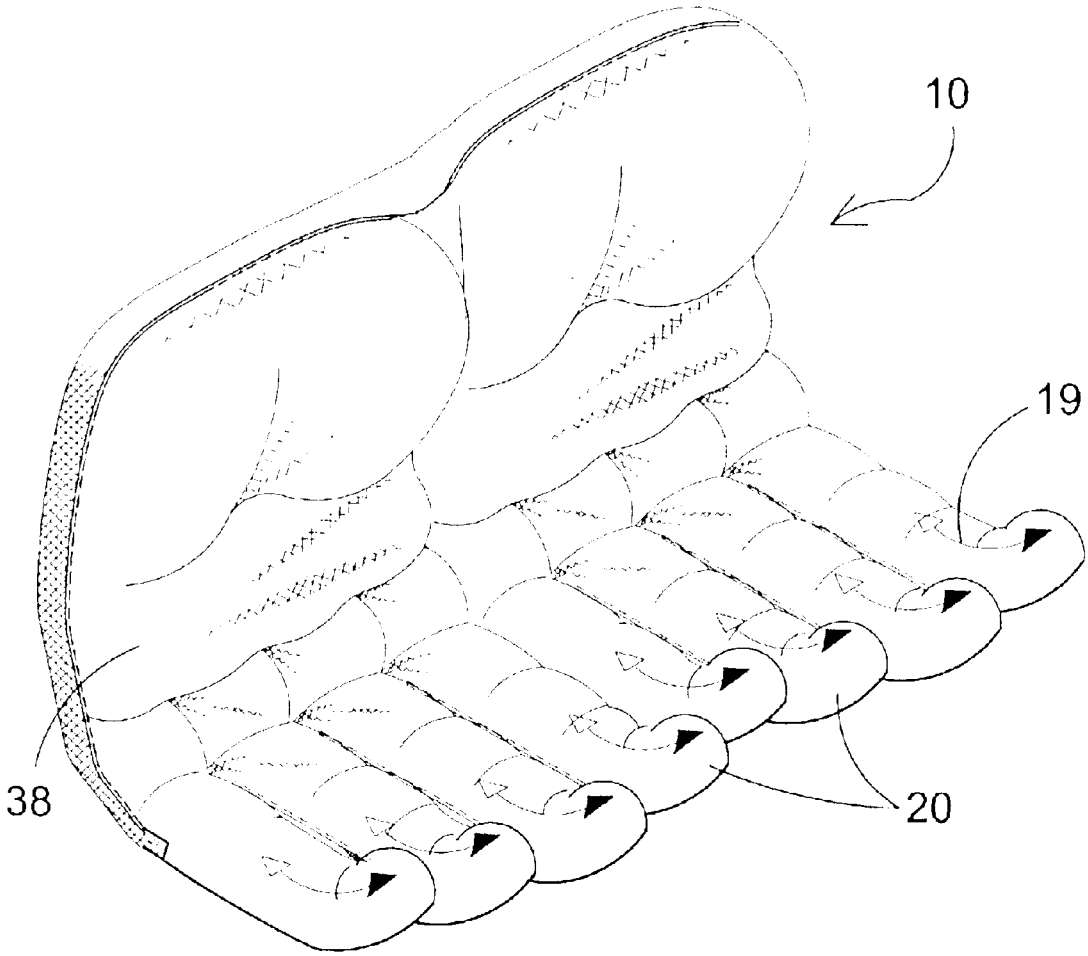
FIG. 7 is an enlarged frontal view of the present invention.

Turning to FIG. 7, shown therein is an enlarged frontal view of the present invention 10. Shown is a padded 38 device 10 having a number of appendages 20 extending therefrom to form a U-shaped receptacle. Also shown by arrows 19 is the original position of the appendages 20 before the pressure of the users head and neck compressed the spring between the third and second appendage members which will provide a consistent forward pressure as the motor rotates the first member.

Figure 8:
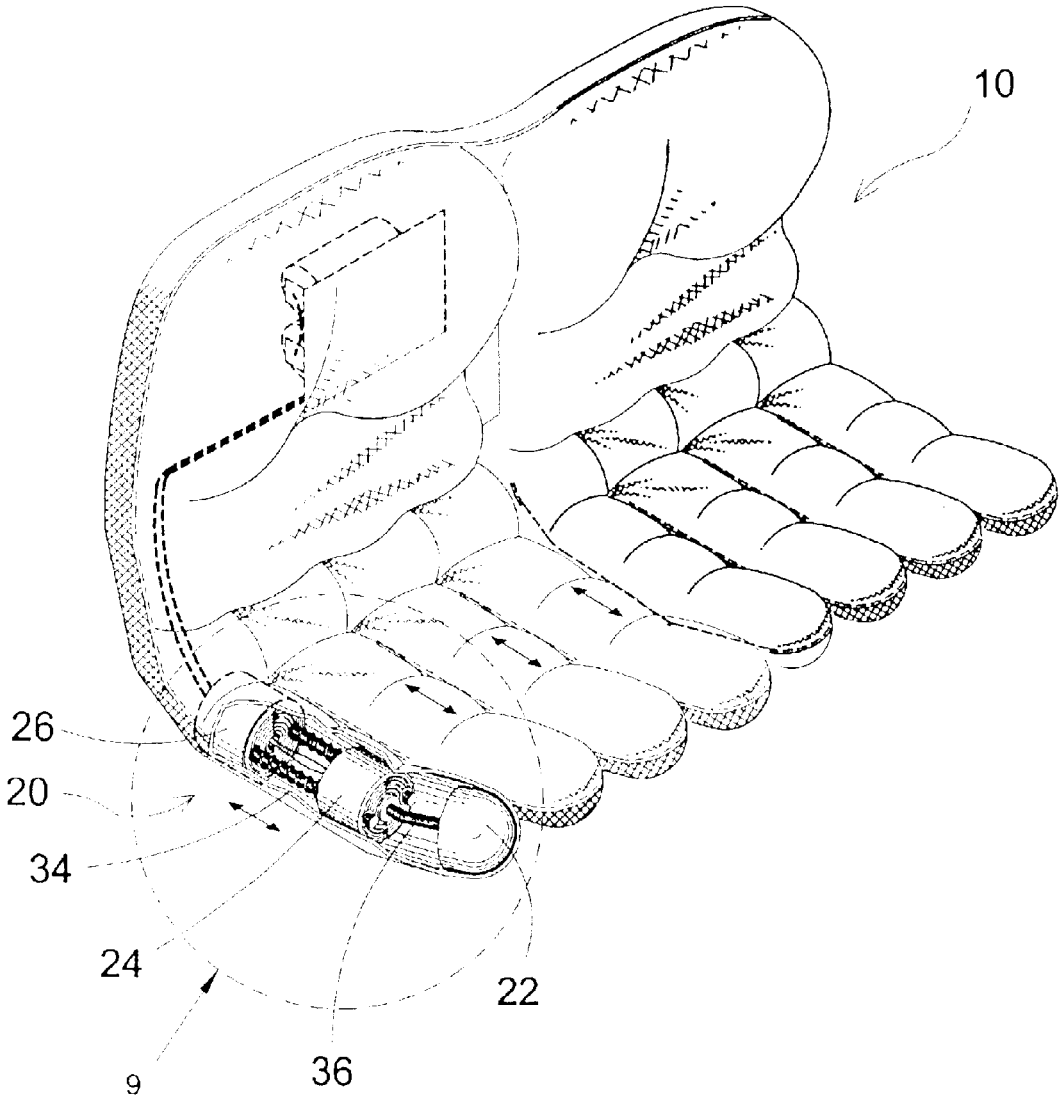
FIG. 8 is a cutaway view of the present invention.

Turning to FIG. 8, shown therein is a cutaway view of one of the appendages 20 of the present invention 10. Shown is a third member 26 which is used to secure the motorized second member 24 by means of springs 34 which will compress as pressure is placed on the device 10. The second member 24 has a shaft 36 as means for joining, securing and rotating the first member 22 in an elliptical trajectory.

Figure 9:
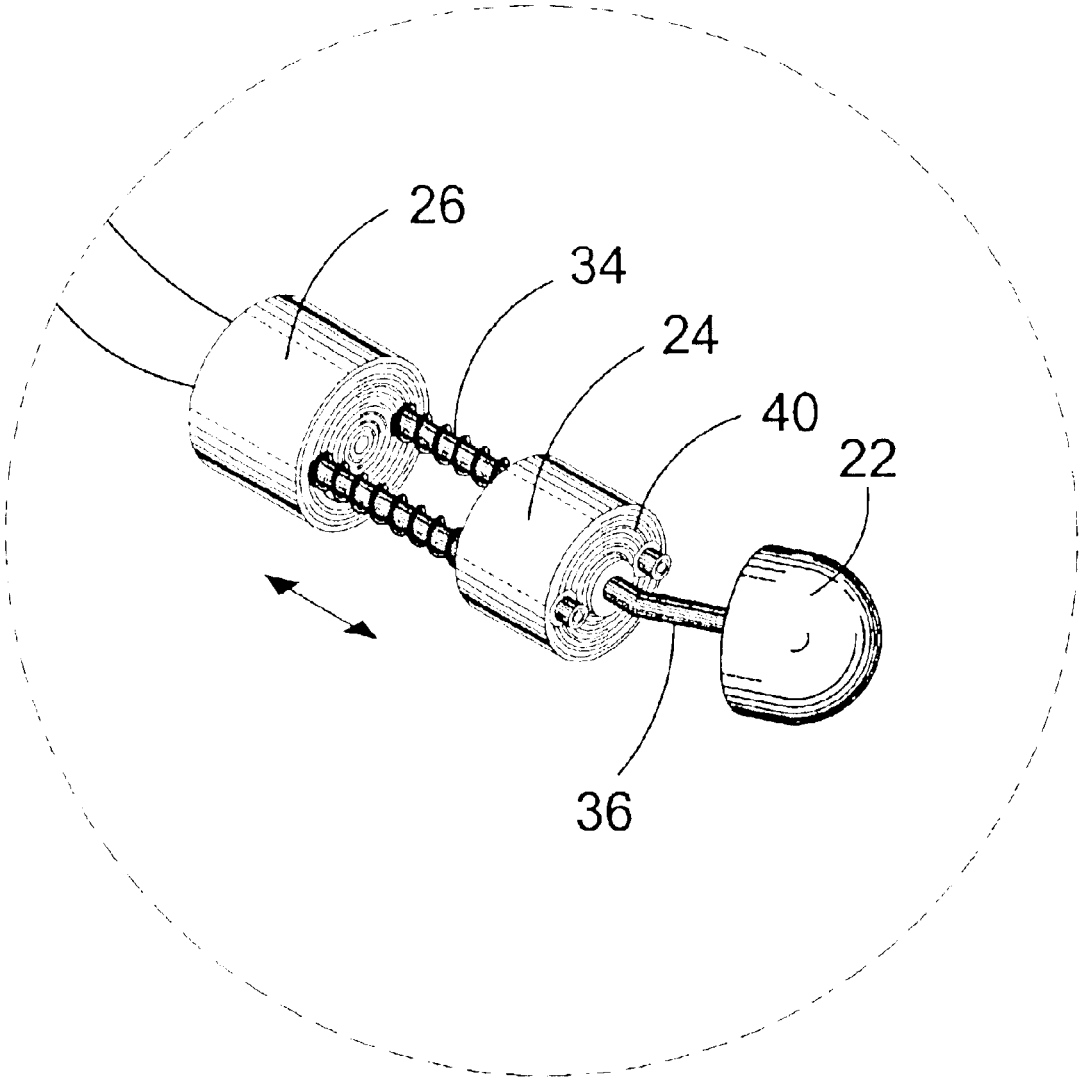
FIG. 9 is an enlarged view of the present invention.

Turning to FIG. 9, shown therein is an enlarged view, taken from FIG. 8 as indicated. Shown is a third member 26 which is used to secure the motorized second member 24 by means of springs 34 which will compress as pressure is placed on the device. The second member 24 has a shaft 36 as means for securing and rotating the first member 22 in an elliptical trajectory. Also shown is a bearing 40 located within the second member 24 to keep the external covering of the appendage from twisting while the internal mechanism rotates in a continuous motion,

What is claimed to be new and desired to be protected by Letters Patent is set forth in the appended claims:

1. An apparatus for massaging the back of the head of a user, comprising:

a) a housing for containing the apparatus, wherein said housing is hand-shaped for receiving the back of the head of a user therein;

b) a palm area disposed on said head hand-shaped;

c) a plurality of appendages disposed on said housing, said appendages having a first member, a second member and a third member, said appendage having a tip, wherein said first member is disposed on said tip of said appendages;

d) at least one spring disposed between said third member and said second member to bias the first and second members in an outward direction toward the back of the head of the user;

e) wherein said second member comprises a motor to permit the apparatus to move;

f) a rotatable shaft connecting said second member to said first member to permit the first member to move in response to the motor and thereby massage the back of the head of a user; and, g) a power source for said motor.

2. The apparatus of claim 1, wherein said palm area of said housing and said appendages of said housing form a U-shaped receptacle for receiving the head of a user.

3. The apparatus of claim 2, further comprising a padded cover for covering said housing for comfortably receiving the head of a user.

4. The apparatus of claim 3, wherein said housing has the shape of a pair of hands placed side-by-side for receiving the head of a user.

5. The apparatus of claim 4, wherein said shaft is angled at its approximate center to permit said first member to move in a random elliptical path.

6. The apparatus of claim 5, further comprising a bearing disposed about said shaft at its connection to said motor to permit said padding cover to remain in place as said first member moves in a random elliptical path.

7. The apparatus of claim 6, wherein said power source further comprises at least one battery connected to said motor by electrical wiring for providing energy to said motor.

8. The apparatus of claim 7, further comprising means for connecting the apparatus to a proximate object whereby the apparatus is removably secured to a proximate object for massaging the back of a user.

9. The apparatus of claim 8, wherein said means for connecting comprises hook and loop material.

10. The apparatus of claim 8, wherein said means for connecting comprises a buckle.

11. The apparatus of claim 8, wherein said means for connecting comprises a belt.

12. The apparatus of claim 8, wherein said means for connecting comprises a snap.

13. The apparatus of claim 8, wherein said means for connecting comprises a pin.

14. The apparatus of claim 8, wherein said proximate object is a chair.

15. The apparatus of claim 8, wherein said proximate object is a floor.

* * * * *